US010457460B2

(12) United States Patent
Futase

(10) Patent No.: US 10,457,460 B2
(45) Date of Patent: Oct. 29, 2019

(54) PACKAGING BAG

(71) Applicant: YUSHIN CO., LTD., Niigata (JP)

(72) Inventor: Katsunori Futase, Niigata (JP)

(73) Assignee: YUSHIN CO., LTD., Niigata (JP)

( * ) Notice: Subject to any disclaimer, the term of this patent is extended or adjusted under 35 U.S.C. 154(b) by 218 days.

(21) Appl. No.: 15/305,505

(22) PCT Filed: Jun. 6, 2014

(86) PCT No.: PCT/JP2014/065106
§ 371 (c)(1),
(2) Date: Oct. 20, 2016

(87) PCT Pub. No.: WO2015/186251
PCT Pub. Date: Dec. 10, 2015

(65) Prior Publication Data

US 2017/0043926 A1 Feb. 16, 2017

(30) Foreign Application Priority Data

Jun. 4, 2014 (JP) ..... 2014-115412

(51) Int. Cl.
*B65D 75/58* (2006.01)
*B65D 75/00* (2006.01)

(52) U.S. Cl.
CPC ..... *B65D 75/5883* (2013.01); *B65D 75/008* (2013.01); *B65D 75/5816* (2013.01); *B65D 75/5866* (2013.01)

(58) Field of Classification Search
CPC ..... B31B 19/60; B31B 2150/00; B31F 1/20; B65D 75/5883; B65D 33/00;
(Continued)

(56) References Cited

U.S. PATENT DOCUMENTS 3,255,872 A * 6/1966 Shaw ..... F24V 30/00 206/219
3,847,279 A * 11/1974 Montgomery ..... B01L 3/502 206/219
(Continued)

FOREIGN PATENT DOCUMENTS

CN 103201095 7/2013
JP 2005-15029 1/2005
(Continued)

OTHER PUBLICATIONS

Machine Translation of JP2010260614A, Futase Katsunori, Liquid Filling and Packaging Structure, Aug. 4, 2011.*
(Continued)

*Primary Examiner* — Anthony D Stashick
*Assistant Examiner* — Onekki P Jolly
(74) *Attorney, Agent, or Firm* — Greenblum & Bernstein, P.L.C.

(57) ABSTRACT

In a packaging bag including a main bag body made of laminate films and a film-shaped pouring nozzle made of laminate films being thinner than the laminate film for the main bag body and developing a self-sealing function, the main bag body is provided on an edge part of a portion formed by cutting out at least a shoulder part with a notch part for fixing and holding the film-shaped pouring nozzle, and the notch part is formed as a protect cover separatably connected to the cutout edge part to house the film-shaped pouring nozzle therein, and an outer face of a base part of the pouring nozzle is fusion-joined to an inner face of the cutout edge part of the main bag body and connected to the main bag body.

11 Claims, 6 Drawing Sheets

(58) Field of Classification Search
CPC .. B65D 75/008; B65D 35/38; B65D 2207/00; B65D 2547/06; B65D 2547/063
USPC ... 206/484, 484.2, 221, 542.1, 524.2, 524.8, 206/494, 222, 219, 218; 222/92, 107, 222/541.6, 541, 9; 383/200, 906
See application file for complete search history.

(56) References Cited

U.S. PATENT DOCUMENTS 4,402,402 A * 9/1983 Pike ..... B65D 81/3266 206/219
4,452,378 A * 6/1984 Christine ..... B65D 75/5883 222/107
4,527,687 A * 7/1985 Hollander, Jr. .... B65D 75/5883 206/219
4,958,735 A * 9/1990 Odabashian ..... B65D 75/002 206/471
5,928,213 A * 7/1999 Barney ..... A61J 1/10 206/219
5,957,584 A * 9/1999 Lakey ..... B65D 75/5883 383/104
5,971,613 A * 10/1999 Bell ..... B29C 65/18 383/104
6,174,083 B1 * 1/2001 Delefortrie ..... B65D 75/5822 383/200
6,244,747 B1 * 6/2001 Caudle ..... B29C 65/7461 383/104
6,298,984 B1 * 10/2001 Weaver ..... B01F 11/0065 206/219
8,418,886 B2 * 4/2013 Kasai ..... B65D 75/5866 222/107
8,734,015 B2 * 5/2014 Futase ..... B65D 75/008 383/104
8,870,026 B2 * 10/2014 Kasai ..... B65D 75/5866 222/107
2001/0015054 A1 * 8/2001 Caudle ..... B29C 65/7461 53/459
2002/0118895 A1 * 8/2002 Watabe ..... B65D 75/004 383/104
2005/0271306 A1 * 12/2005 Murray ..... B29C 65/08 383/38
2006/0016889 A1 * 1/2006 Wenger ..... G07B 15/00 235/451
2007/0133909 A1 * 6/2007 Arvizu ..... B65B 9/08 383/104
2010/0209025 A1 8/2010 Futase
2013/0217556 A1 8/2013 Mori et al.
2015/0158635 A1 * 6/2015 Gum ..... B65D 75/008 383/25
2015/0367614 A1 * 12/2015 Sasaki ..... C09D 143/02 428/522
2017/0057723 A1 3/2017 Mori et al.

FOREIGN PATENT DOCUMENTS

JP 2005-59958 3/2005
JP 2009-292527 12/2009
JP 2010-018323 1/2010
JP 2010-095272 4/2010
JP 2010-260614 11/2010
JP 2011-148538 8/2011
JP 2013-189207 9/2013
JP 2014-009030 1/2014
JP 2014-94760 5/2014

OTHER PUBLICATIONS

Machine Translation of JP 2014009030A, Futase Katsunori, Packaging Bag, PAcking Body Using the Same and Method of Manufacturing this Packaging Bag, Jan. 20, 2014.*
International Preliminary Report on Patentability for PCT/JP2014/065106 dated Dec. 15, 2016, along with English-language translation thereof.
Chinese Office Action for CN App. No. 201480079542.0 dated Mar. 19, 2018.
Office Action issued in European Patent Office (EPO) Counterpart Patent Appl. No. 14893850.9, dated Jan. 19, 2018.
International Search Report issued in International Application No. PCT/JP2014/065106, dated Sep. 22, 2014, along with English-language translation.

* cited by examiner

PACKAGING BAG

TECHNICAL FIELD

This invention relates to a packaging bag used advantageously when a packed material filled at an airtight state is poured repeatedly without deteriorating quality thereof. The invention is concerned with a packaging bag comprising a main bag body made from a relatively thick laminate film having an inner space for filling a liquid packed material such as food and drink, medicine, cosmetics, solvent and so on, and a film-shaped pouring nozzle attached to an upper part of the main bag body and made from a laminate film being thinner than the main bag body and having a self-sealing function (non-return function).

RELATED ART

As a film-shaped pouring nozzle having a self-sealing function (hereinafter referred to as "film-shaped pouring nozzle" simply) and a package bag provided therewith are included ones as disclosed in Patent Documents 1 and 2. The film-shaped pouring nozzle disclosed in these documents is formed by superimposing one or two of thin and flat laminate films provided on their front and rear faces with sealant layers and fusion-joining peripheral parts thereof other than base end sides. The feature of the film-shaped pouring nozzle lies in that the pouring of the liquid packed material inside the bag body is attained based on crushing deformation of the main bag body or the like without sucking ambient air into the main bag body, while when the pouring is stopped based on standing displacement of the main bag body, inner faces of a pouring path in the film-shaped pouring nozzle are closed immediately under interposition (surface tension) of a thin film of the liquid packed material associated with wetting through capillary action or the like of the liquid packed material to develop self-sealing function for preventing penetration of ambient air into the main bag body.

In the package bags of Patent Documents 1 and 2, the main bag body is also constituted from the soft laminate films. In order to impart strength and independence required as a package in use, it is inevitable to take a double bag structure of a package faulted by filling a liquid packed material in the soft packaging bag and a self-supporting outer container for housing it therein, and it is necessary to fix the upper part of the package to the outer container in use.

PRIOR ART DOCUMENTS

Patent Documents

Patent Document 1: JP-A-2005-15029
Patent Document 2: JP-A-2005-59958
Patent Document 3: JP-A-2010-260614

SUMMARY OF THE INVENTION

Task to be Solved by the Invention

SUMMARY OF THE INVENTION

Task to be Solved by the Invention

The packaging bag disclosed in Patent Document 3 has an issue that the cost becomes higher because it is necessary to provide an inner package formed by airtightly filling and packing the liquid packed material and an outer container separate therefrom and the manufacturing step of housing and fixing the inner package in the outer container.

Since the pouring nozzle in the inner package and a portion of the outer container corresponding to the pouring nozzle take a structure of protruding from a side edge of the main bag body or the main body of the outer container, when they are housed in a box for transportation or the like or displayed on a store shelf, the protruding portion becomes cloggy and hence there is a problem that the housing or displaying space becomes extra wider or a fear that the film-shaped pouring nozzle is bended to obstruct the effective development of the self-sealing function or cause breakage or the like.

It is, therefore, a first object of the invention to provide a packaging bag not requiring a separate outer container for assisting the self-supporting of the packaging bag, reducing the cost by simplification of the manufacturing process, decreasing the housing or displaying space by inhibiting the protrusion of a film-shaped pouring nozzle from an upper edge portion or a side edge portion of the packaging bag and having no fear of bending or breakage in the film-shaped pouring nozzle.

The another objects of the invention are to provide a packaging bag being hygienic and excellent in the antibacterial activity without contacting the film-shaped pouring nozzle for pouring contents with ambient air at least until just before use and having no fear of breakage, and further to provide a packaging bag capable of stably self-supporting the packaging bag till the last.

Solution for Task

In order to achieve the above objects, the invention is developed and relates to a packaging bag comprising a main bag body formed by superimposing and affixing two laminate films each having a counter profile defined by an upper edge part, a lower edge part and a pair of side edge parts sandwiched therebetween or affixing two folded portions of the laminate film to form a filling space for a packed material therein, and a film-shaped pouring nozzle attached to an upper portion of the main bag body and formed by superimposing and affixing two separate laminate films thinner than the laminate film for the main bag body or affixing two folded portions of the latter laminate film and mutually fusion-joining three peripheral portions thereof other than an end portion as a base part to form a pouring path communicating to the filling space of the main bag body and developing a self-sealing function when the packed material in the filling space is poured through the pouring path.

The main bag body of the packaging bag is provided with a notch part by cutting out at least one shoulder part so as to communicate a portion of the upper edge part to a portion of the side edge part and fixing and holding the film-shaped pouring nozzle to an cutout edge part so as to fit the nozzle into the shoulder part intersecting with the upper edge part and side edge part of the main bag body, and the notch part has an outer edge extending from the upper edge part and side edge part of the main bag body and is connected to the cutout edge part separateably and formed as a protect cover housing the film-shaped pouring nozzle therein.

In this packaging bag, the film-shaped pouring nozzle is connected to the main bag body by fusion-joining an outer face of the base part to the inner face of the cutout edge part in the main bag body so as to leave inner faces of the pouring path.

In the packaging bag according to the invention, the followings are preferable solution means:

(1) a reinforcing seal portion is provided on a boundary portion between the upper and lower end portions of the base part in the film-shaped pouring nozzle and the cutout edge part in the main bag body by performing at least one pressurized fusion treatment after the fusion-joining of the nozzle and the main bag body;

(2) the laminate film for the film-shaped pouring nozzle is a film in which a melting point of a sealant layer located at the inner face side of the pouring path of the film-shaped pouring nozzle is higher than a melting point of a sealant layer located at an outer face side contacting with the laminate film of the main bag body;

(3) the protect cover is comprised of a pair of bag-shaped laminate films having a form corresponding to the notch part for housing the film-shaped pouring nozzle at a sandwiched state;

(4) the cutout edge part formed in the shoulder part of the main bag body comprises an inclination edge part linearly inclined from the upper edge part of the laminate film for the main bag body toward the side edge part thereof at a downward gradient, a curved edge part expanded toward the filling space of the main bag body, or one or more horn-shaped edge parts connecting them to each other;

(5) the pouring path in the film-shaped pouring nozzle is formed upward, obliquely upward or parallel to the upper edge part of the main bag body;

(6) the upper edge parts other than the notch part in the main bag body are separated from each other to fill the packed material into the filling space and thereafter the upper edge parts are fusion-joined to seal the filling space;

(7) the film-shaped pouring nozzle is provided with at least one irregular stripe extending across the pouring path and entering between the mutually superimposed laminate films for the nozzle;

(8) the main bag body is provided with a bottom wall self-supporting the main bag body and the bottom wall is fusion-joined to an inner face wall located at a lower side of the laminate film for the main bag body to form a ship bottom type bottom portion at the lower end of the filling space, while the lower edge parts thereof are separated away from each other to contact their end portions to ground;

(9) a gas is encapsulated into the filling space of the main bag body at an amount of not less than 2 vol % per volume of the packed material filled under atmospheric pressure.

Effect of the Invention

In the packaging bag according to the invention, the film-shaped pouring nozzle is fixed and held to the inside of the notch part formed by cutting out the shoulder part intersected with the upper edge part and side edge parts of the main bag body, so that the film-shaped pouring nozzle does not protrude from the upper edge part or side edge part of the main bag body and hence the housing or displaying space can be decreased and the handling is easy and there is no fear of bending or breaking the film-shaped pouring nozzle.

In the packaging bag according to the invention, the main bag body is made of relatively thick laminate films to thereby impart a strength required as a package, while it is formed at a self-supporting state, so that it is not necessary to provide a separate outer container and the production process can be simplified to decrease the cost.

In the packaging bag according to the invention, the protect cover is arranged so as to house the film-shaped pouring nozzle held at the cutout edge part of the main bag body therein, so that the film-shaped pouring nozzle is not exposed to exterior till the start of use, which is hygienic and excellent in the antibacterial activity, and also there is no fear of breaking the film-shaped pouring nozzle. When the protect cover in such a main bag body is constituted with a pair of bag-like laminate films, the film-shaped pouring nozzle can be maintained at a flat state. Furthermore, even if the protect cover is cut out, a portion of the film-shaped pouring nozzle in the vicinity of the base part can be restrained by the residual portion of the bag-like laminate films to suppress bending of the film-shaped pouring nozzle.

In the packaging bag according to the invention, the reinforcing seal portion is formed in the boundary portion between upper and lower portions of the base part of the film-shaped pouring nozzle and the cutout edge part of the main bag body by further performing the pressurized fusion treatment after the fusion-joining of them, whereby pinholes inevitably caused in the joining between the thick laminate film for the main bag body and the thin laminate film for the nozzle can be prevented and the fusion strength of the boundary portion can be increased, and hence the breakage of the bag in the boundary portion can be suppressed to effectively prevent the leakage of the packed material.

In the packaging bag according to the invention, when the melting point of the sealant layer located at the inner face side of the pouring path in the laminate film constituting the film-shaped pouring nozzle is made higher than that of the sealant layer located at the outer face side, the fusion between the mutual inner faces in the film-shaped pouring nozzle can be prevented sufficiently in the integral connection of the base part of the film-shaped pouring nozzle to the main bag body by fusion-joining to the inner face of the cutout edge part of the main bag body.

In the packaging bag according to the invention, the cutout edge part formed in the shoulder part of the main bag body is made to an inclination edge part linearly inclined from the upper edge part of the laminate film for the main bag body toward the side edge part thereof at a downward gradient, a curved edge part expanded toward the filling space of the main bag body, or one or more horn-shaped edge parts connecting them to each other, whereby the form of the film-shaped pouring nozzle fixed and held to the cutout edge part or the pouring direction of the packed material from the film-shaped pouring nozzle can be changed properly.

In the packaging bag according to the invention, it is preferable that at least one irregular stripe extending across the pouring path and entering between the mutually superimposed laminate films for the nozzle is arranged at a position in the vicinity of the pouring port in the laminate films for the nozzle constituting the film-shaped pouring nozzle. Since the elastic restoring force is increased by the irregular stripe, the mutual adhesion between the laminate films for the nozzle becomes rapid and sure when the pouring of the packed material is stopped by returning the packaging bag to a standing posture, and hence the self-sealing function can be developed effectively, which is particularly effective when a gas is encapsulated into the main bag body together with the packed material.

In the packaging bag according to the invention, a self-supporting bottom wall is disposed in the lower end of the main bag body, whereby it is possible to self-support the packaging bag itself. Further, the standing posture of the main bag body can maintain a cylindrical form at its lower portion and a flat form at its upper portion even after the filling of the liquid packed material, so that the non-return function of the film-shaped pouring nozzle can be developed effectively.

In the conventional packaging bag, since the penetration of ambient air is blocked by the self-sealing function inherent to the film-shaped pouring nozzle, the main bag body is gradually shrunk associated with the pouring of the packed material. In the invention, however, a gas is encapsulated into the filling space of the main bag body together with the packed material, so that the shrinking of the main bag body associated with the pouring of the packed material can be suppressed to stably self-support the packaging bag till the last.

BEST MODE FOR CARRYING OUT THE INVENTION

An embodiment of the packaging bag according to the invention will be described with reference to the accompanying drawings below.

Figure 1:
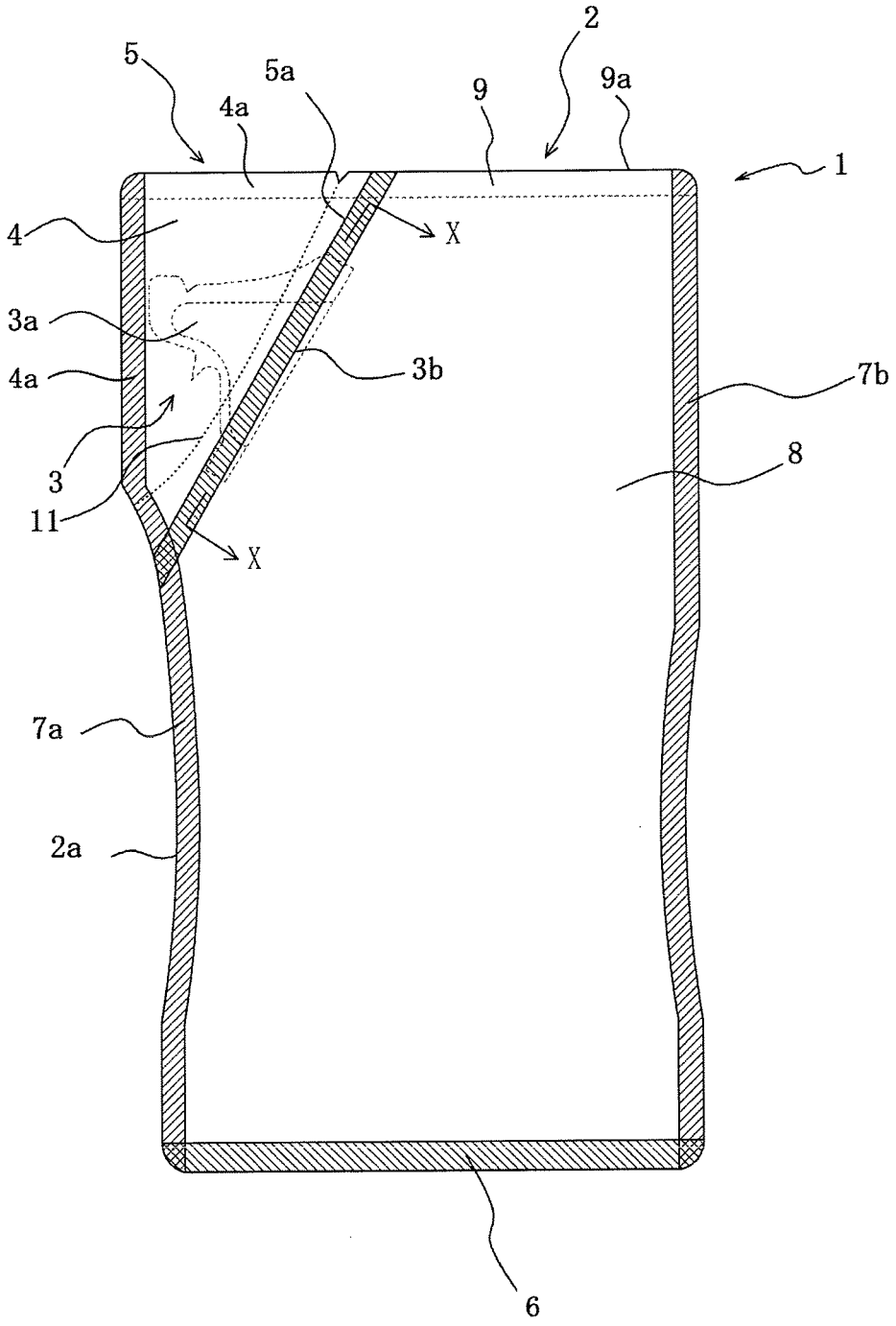
FIG. 1 is a front view illustrating an embodiment of the packaging bag according to the invention.

As shown in FIG. 1, a packaging bag 1 according to the invention comprises a main bag body 2 for housing and holding a packed material and a film-shaped pouring nozzle 3 for pouring the packed material inside the main bag body 2.

The main bag body 2 is formed by superimposing laminate films of two or more layer lamination structure comprised of a base film layer and a sealant layer located in a portion of at least contacting the packed material with an outer sealant layer of the film-shaped pouring nozzle, two films in this figure (superimposing the sealant layers so as to oppose to each other) and fusion-joining lower edge parts 6 and a pair of side edge parts 7*a*, 7*b* thereof to form a filling space 8 for the packed material therein.

As a characteristic construction of the main bag body 2 according to the invention, a shoulder part of intersecting the side edge part 7*a* with an upper edge part 9 is provided with a notch part 5 of, for example, an approximately triangular geometry formed by cutting out portions of the side edge part 7*a* and upper edge part 9, and an outer face of a base part 3*b* (outer sealant layer) of the film-shaped pouring nozzle 3 is fixed and held (connected) to an inner face of the laminate film of the cutout edge part 5*a* by performing heat fusion treatment (heat sealing) so as to leave a pouring path therein.

The main bag body 2 may be formed by folding one laminate film for the main bag body at its central portion instead of the aforementioned superimposition of the two laminate films. Although the notch part 5 is formed only at a side of the side edge part 7*a*, it may be formed at a side of the side edge part 7*b* or at both sides of the side edge part 7*a* and side edge part 7*b*.

The film-shaped pouring nozzle 3 is separate from the main bag body and is attached to an upper portion of the main nag body, particularly a portion of the shoulder part by fusion. Also, the film-shaped pouring nozzle 3 is comprised of at least a base film layer and sealant layers laminated on both faces thereof, and is formed by superimposing two plastic laminate films or folding one laminate film being softer and thinner than the laminate film for main bag body and having a high flatness and fusing three peripheral parts other than an end side as a base part 3 to each other to form a pouring path 3*a* communicating to the filling space 8 of the main bag body 2 therein. Moreover, the liquid packed material is always interposed in membrane between inner faces of the pouring path 3*a* in the film-shaped pouring nozzle 3 through capillary action or the like. As a result, the inner faces of the pouring path are mutually adhered to each other through surface tension, whereby the self-sealing function for blocking penetration of ambient air instead of the packed material poured can be developed.

Moreover, when the film-shaped pouring nozzle 3 is fixed and held to the inner face of the cutout edge part 5*a* by fusion-joining or the like, it is preferable to use a laminate film for the nozzle wherein a melting point of a sealant layer located side an inner face of the pouring path 3*a* is higher, for example, by about 20° C. than that of a sealant layer located side an outer face of the film-shaped pouring nozzle 3. Furthermore, as the sealant layer located side the outer face, a film heat-sealable at a temperature higher than a heat sealing temperature of an inner face of the cutout edge part 5*a* (sealant layer of the laminate film for the main bag body) is preferable. According to such a laminate film, the base part 3*b* of the film-shaped pouring nozzle 3 can be surely fusion-joined to the cutout edge part 5*a* as is expected without interposing a releasing material or another fusion-preventive material between the sealant layers in the inner faces of the pouring path 3*a* and without fearing an unintended fusion-joining of the mutual inner faces in the film-shaped pouring nozzle 3.

The notch part 5 is formed as a protect cover 4 connected to a cutout edge part 5*a* and having outer edges 4*a* extended from the upper edge part 9 and the side edge part 7*a* of the main bag body 2, in which the film-shaped pouring nozzle 3 is housed inside the outer edges 4*a*. Moreover, the protect cover 4 may be formed as a unit with the main bag body 2 through the laminate films for the main bag body, or may be formed aside from the main bag body 2 and connected thereto at a position of the cutout edge part 5*a* by fusion-joining or the like.

In the packaging bag 1 according to the invention, therefore, the film-shaped pouring nozzle 3 is positioned in the notch part 5 of the main bag body 2 and the outer edges 4*a* of the protect cover 4 housing the film-shaped pouring nozzle 3 therein are formed along the upper edge part 9 and the side edge part 7*a* of the main bag body 2, so that the film-shaped pouring nozzle 3 does not protrude from each edge part of the packaging bag different from the conventional bag. According to the packaging bag having such a construction, it is effective to decrease the housing or displaying space, and there is no fear of mistakenly opening or breaking the film-shaped pouring nozzle in handling.

Figure 2:
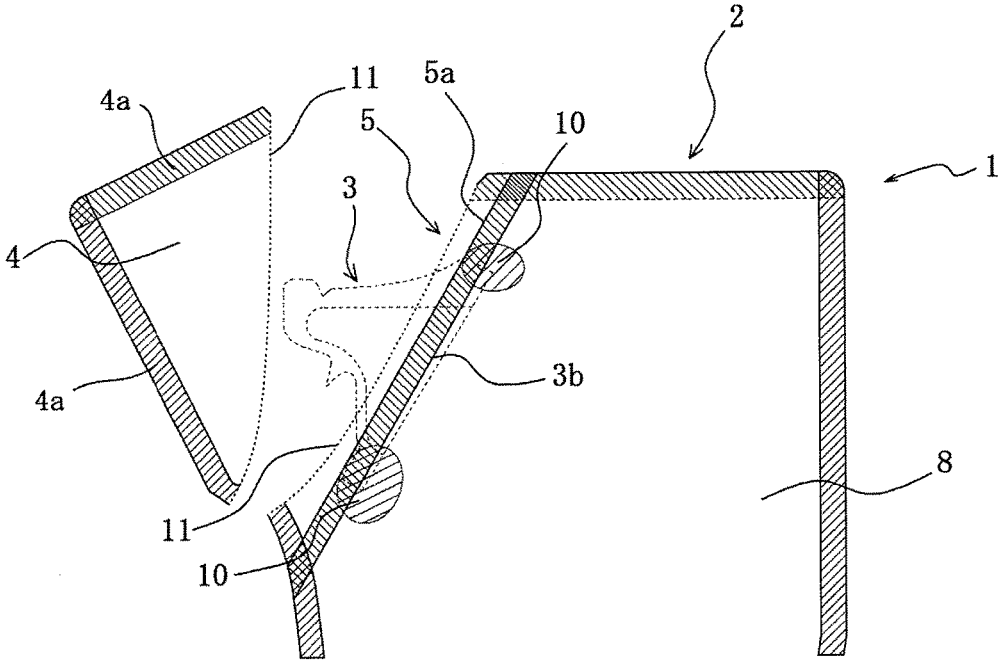
FIG. 2 is a view illustrating a state of cutting out a protect cover from a main bag body.

In the protect cover 4, it is preferable that perforation-like pinholes or tear guiding trace 11 such as continuous or discontinuous fusion trace or the like formed by laser working or the like is arranged in a position near to the cutout edge part 5*a*. In use, the protect cover 4 is cut out by tearing downward along the tear guiding trace 11 from a starting point of a notch or the like formed, for example, in an upper edge part of the protect cover 4 as shown in FIG. 2, whereby the film-shaped pouring nozzle 3 located therein can be exposed to exterior. Moreover, the protect cover 4 may be cut out by forming a starting point of the tear guiding trace 11 on the side edge part and tearing upward therefrom toward the upper edge part.

The protect cover 4 takes a triangular bag having an approximately triangular form corresponding to the notch part and constructed with a pair of laminate films interleaving the film-shaped pouring nozzle 3 from both sides thereof and enclosing therein. According to the protect cover 4, the film-shaped pouring nozzle 3 can always hold at a flat state through the pair of laminate films interleaving it, so that the self-sealing function can be developed effectively. Further, even if the protect cover 4 is cut out from the main bag body 2, a portion near to the base part 3*b* of the film-shaped pouring nozzle 3 is pushed by residual portion of the pair of laminate films, whereby the bending of the film-shaped pouring nozzle 3 can be suppressed to improve the pouring directionality of the packed material.

The laminate film for the main bag body is a laminate film of two or more layers made of at least base film layer and sealant layer as mentioned above. For example, the base film layer is made from a polyethylene terephthalate film, a nylon resin film, polypropylene, polyethylene or the like, while the sealant layer is made from polyethylene, polypropylene or the like. In order to impart a strength as a package to provide a self-supporting property when filled with a constant amount of the packed material therein, a laminating thickness of the laminate film is 80-300 μm, preferably 100-200 μm. A gas burlier layer comprised of $SiO_2$ deposited layer, vinylidene chloride coating layer, aluminum oxide coating layer, Al deposited layer or a sputtering layer thereof is formed on either surface of the base film layer at a thickness of preferably 0.5-20 μm. In this case, steam impermeability, gas burlier property or the like is given to the main bag body 2, whereby it is possible to keep the packed material inside the main bag body 2 over a long time of period without deterioration.

The laminate film for the film-shaped pouring nozzle 3 is a laminate film of three or more layers being thin and soft as compared to the laminate film for the main bag body and made of a base film layer and sealant layers sandwiching it therebetween, a laminating thickness of which is not less than 30 μm but less than 80 μm, preferably 40-70 μm. The base film layer is preferable to be made of a uniaxially or biaxially oriented film of nylon, polyester, polypropylene, polyethylene terephthalate, EVOH or the like. A gas burlier layer comprised of $SiO_2$ deposited layer, vinylidene chloride coating layer, aluminum oxide coating layer, Al deposited layer or a sputtering layer thereof is formed on either surface of the base film layer at a thickness of preferably 0.5-20 μm. In this case, the inner faces of the film-shaped pouring nozzle wetted with the packed material are well adhered to each other and the steam impermeability, gas burlier property or the like is given to develop the effective self-sealing function over a long time of period, whereby penetration of ambient air into the bag can be blocked. As the sealant layer, it is preferable to use a thermoplastic resin such as polyethylene, polypropylene, ethylene vinyl alcohol, ionomer, EVOH or the like.

Figure 3:
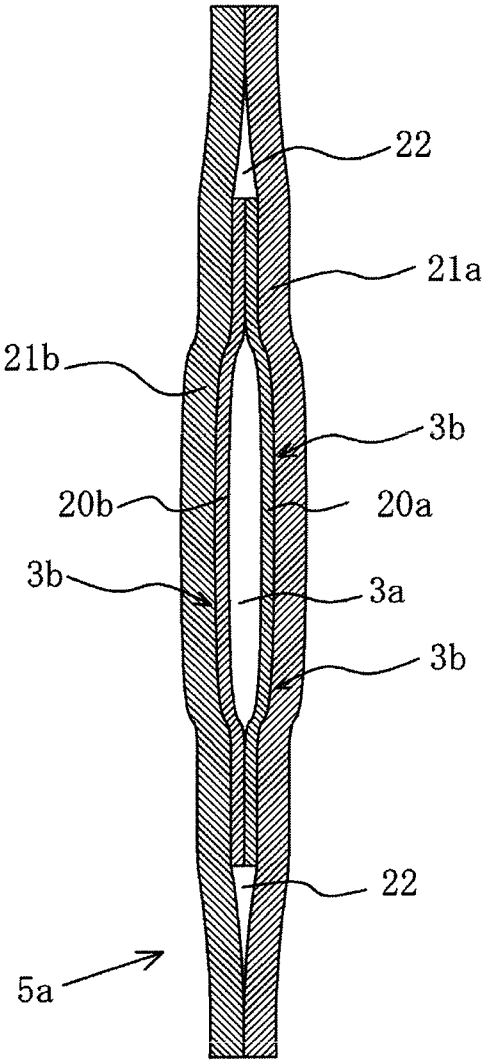
FIG. 3 is a section view taken along a line X-X in FIG. 1.

The film-shaped pouring nozzle 3 is fixed by fusion-joining the outer surface of the base part 3*b* to the laminate film for the main bag body located at the inner face of the cutout edge part 5*a*. As shown in an end view (FIG. 3) at a position of line X-X in FIG. 1, four films of the laminate films for the nozzle 20*a*, 20*b* and the laminate films for the main bag body 21*a*, 21*b* are overlapped with each other in a boundary portion between the base part 3*b* of the nozzle and the cutout edge part 5*a* of the main bag body 2, or both end portions of the base part 3*b* of the nozzle, so that the thickness of the films becomes thicker and hence a gap 22 is easily formed due to the difference of the thickness to the overlapped portion of only the laminate films for the main bag body 21*a*, 21*b* in the cutout edge part 5*a* and there is a fear of leaking out the packed material in the filling space 8 of the main bag body 2 from the gap 22.

In the invention, therefore, boundary portions between upper and lower end portions of the base part 3*b* of the nozzle and the cutout edge part 5*a* of the main bag body 2 (laminate films for the main bag body 21*a*, 21*b*) are preferable to be provided with plural reinforcing seal portions 10 formed by further performing at least one thermal fusion treatment after the fusion-joining between the cutout edge part 5*a* and the base part 3*b* of the nozzle as shown in FIG. 2 and so on. According to this structure, the joint strength between the film-shaped pouring nozzle 3 and the main bag body 2 can be increased and there is no fear of liquid leakage. Also, the strength of the film-shaped pouring nozzle 3 made of the thin and soft laminate films can be made equal to the film strength of the main bag body 2 by the reinforcing seal portion 10, so that the pouring performance can be improved without bending the film-shaped pouring nozzle 3 at the position of the base part 3*b*.

Figure 4:
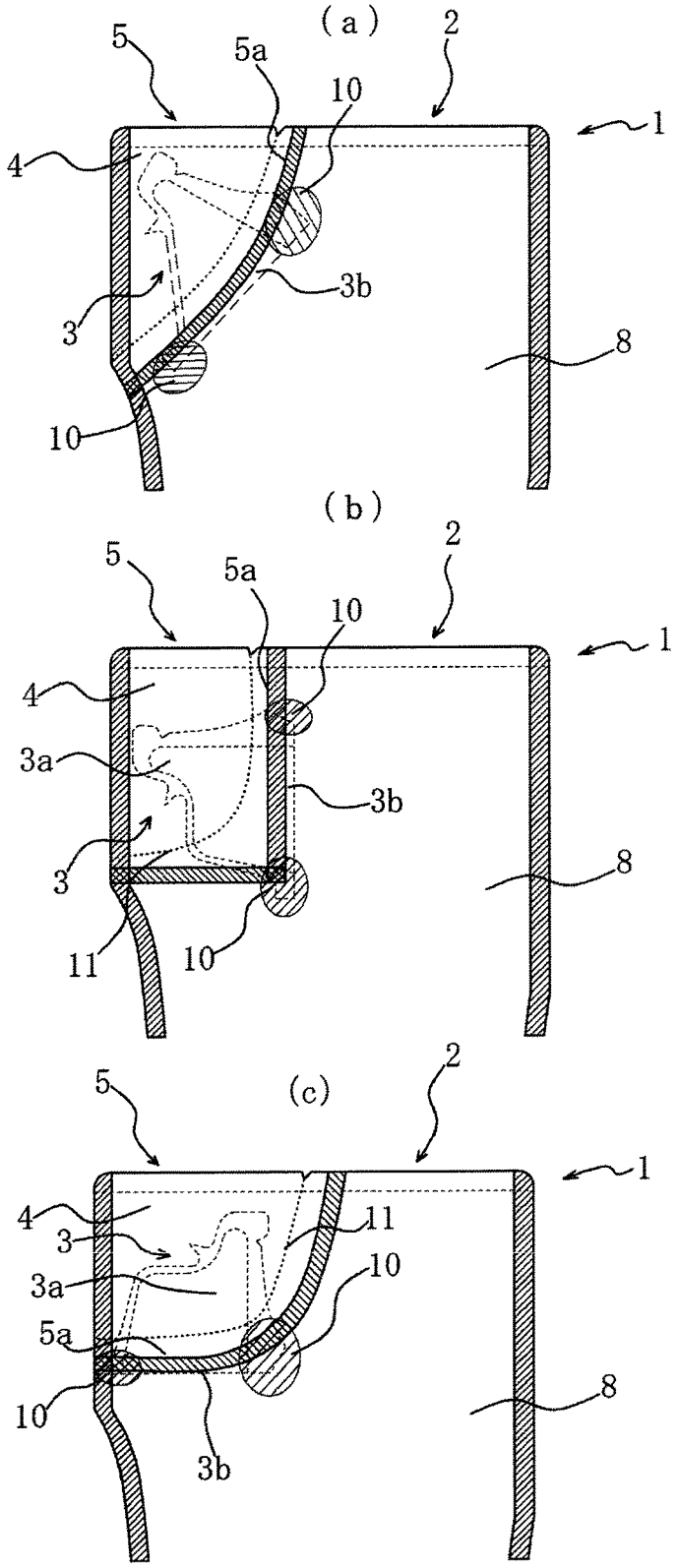
FIG. 4 is partial enlarged views illustrating another embodiments of the cutout edge part.

The cutout edge part 5*a* of the notch part 5 is preferable to be an inclination edge part linearly inclined from the upper edge part 9 of the main bag body 2 toward the side edge part 7*a* of the film as shown in FIG. 1, or a curved edge part (a), (c) expanded toward the filling space 8 or a horn-shaped edge part (b) connecting one or plural corner portions (one in the figure) to each other as shown in FIG. 4. The form of the cutout edge part 5*a* is properly determined in accordance with the pouring direction of the packed material from the film-shaped pouring nozzle 3, the form of the film-shaped pouring nozzle 3 or the like. Moreover, the film-shaped pouring nozzle 3 is arranged so as to make the pouring path 3*a* parallel to the upper edge part 9 of the main bag body 2 as shown in FIGS. 1 and 4(*b*), or may be arranged so as to render the pouring path 3*a* into an obliquely upward direction as shown in FIG. 4(*a*) or in an upward direction (just above) as shown in FIG. 4(*c*). In the latter case, when the packaging bag 1 is returned to a standing posture after the pouring of the packed material, liquid returning of the packed material into the pouring path 3*a* can be improved to suppress the occurrence of liquid dripping effectively.

In such a packaging bag 1, it is preferable that the laminate films for the main bag body overlapped on the upper edge part 9 of the main bag body 2 other than the notch part 5 are separated away from each other and the packed material is filled in the filling space 8 of the main bag body 2, for example, under deaeration through in-liquid seal-filling or at a state of diffusing microbubbles of nitrogen or carbon dioxide gas (diameter of about 1 μm to 150000 μm) into the packed material and thereafter the upper edge part 9 is fusion-joined to seal the filling space 8 airtightly.

Figure 5:
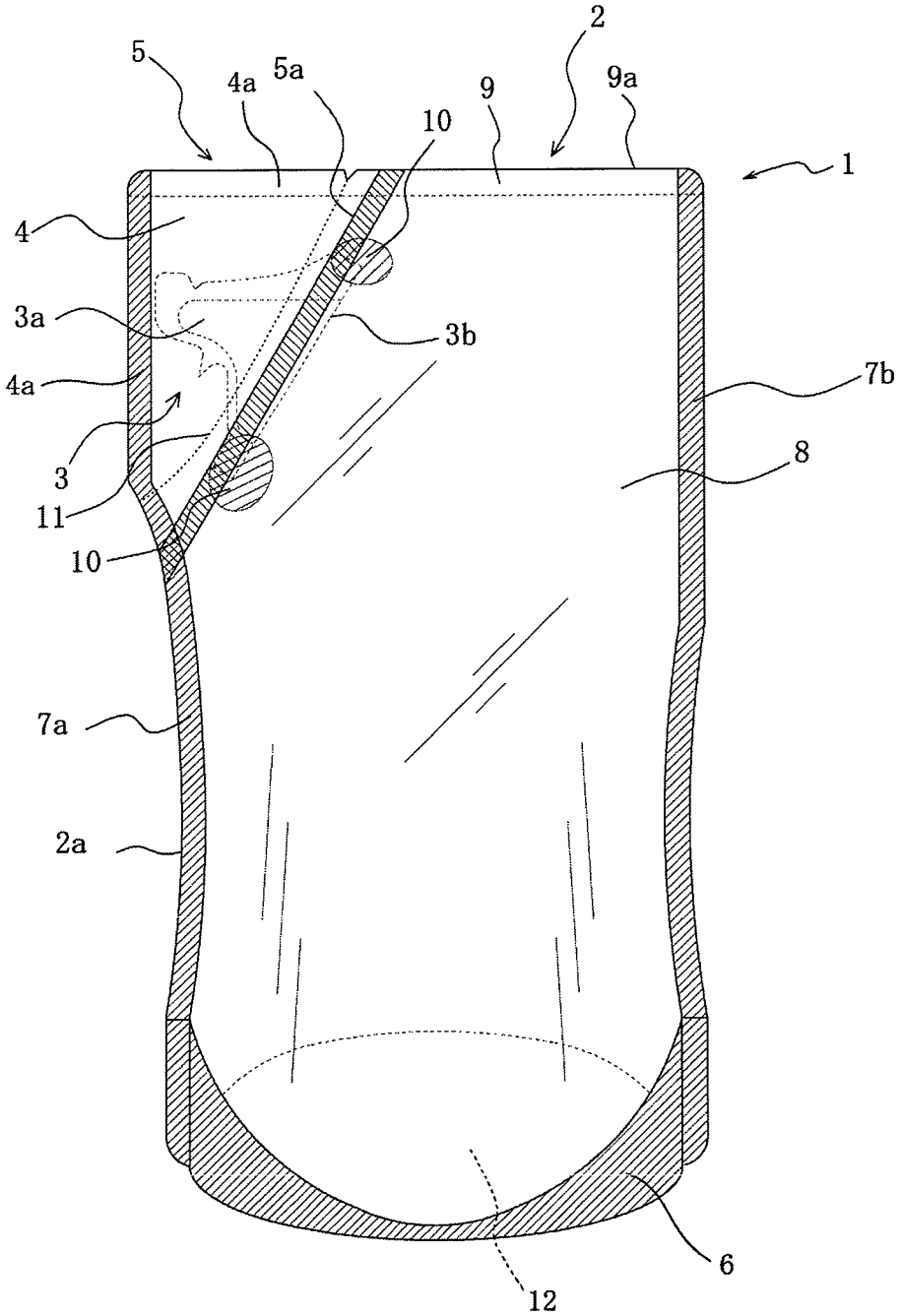
FIG. 5 is a front view illustrating another embodiment of the packaging bag according to the invention.

In another embodiment of the packaging bag 1 according to the invention shown in FIG. 5, a self-supporting bottom portion 12 of a ship bottom type is formed by a bottom wall disposed in a lower edge part 6 of the laminate films for the main bag body corresponding to the lower end of the main bag body 2. The bottom wall is made, for example, from the same laminate film as the laminate film for the main bag body or a film being thick and chewy as compared to the laminate film for the main bag body. The bottom wall is heat-sealed together with the laminate film for the main bag body to a required form at a state of inserting between the overlapped laminate films for the main bag body and fusion-joined to inner edge faces of the lower edge parts 6 of the laminate films for the main bag body to form the self-supporting bottom portion 12. In the packaging bag 1 provided with the self-supporting bottom portion 12, when the packed material is filled into the filling space 8 of the main bag body 2, the lower edge parts 6 of the laminate films for the main bag body are separated away from each other to contact their end portions to ground, whereby the packaging bag 1 can be self-supported.

Since penetration of ambient air into the packaging bag is blocked by the self-sealing function of the film-shaped pouring nozzle 3, the main bag body 2 is shrinking associated with the pouring of the packed material. In the packaging bag 1 having the self-supporting bottom portion 12 as shown in FIG. 5, therefore, it is preferable to encapsulate a gas of nitrogen or carbon dioxide together with the packed material into the filling space 8 of the main bag body 2 at an amount of not less than 2 vol %, preferably not more than 30 vol % per volume of the packed material. In such a construction, the shrinking of the main bag body 2 can be suppressed by the gas to stably self-support the packaging bag 1 till the last. Even when the residual amount of the packed material is decreased up to not more than ⅓, the adhesion force between the mutual inner faces of the main bag body 2 (two laminate films for the main bag body) is mitigated by the gas, while the flowing of the packed material is guided (replaced) into a space occupied with the gas, whereby the packed material can be poured smoothly and the residual amount of the packed material in the bag can be decreased.

Moreover, the gas encapsulated into the main bag body 2 together with the packed material is preferable to be selected in accordance with the kind of the packed material. Particularly, when the packed material is easily oxidized or contaminated with air (for example, seasoning such as soy source or the like, oils, cosmetics, medicines and so on), it is preferable to use an inert gas such as nitrogen gas, carbon dioxide gas or the like. On the other hand, when the quality is not deteriorated even by contacting the packed material with a constant amount of an active gas (for example, various alcohols), an active gas such as oxygen, diluted air or the like may be used. In the invention, since the film-shaped pouring nozzle 3 has a self-sealing function as previously mentioned, the penetration of ambient air into the main bag body 2 is blocked by the film-shaped pouring nozzle 3 and hence the growth of aerobic bacteria in the main bag body 2 can be suppressed effectively. However, since the amount of dissolved oxygen in the main bag body 2 is small, there is a problem of fearing the growth of anaerobic bacteria such as *Clostridium botulinum* and *Clostridium perfringens*. In this connection, a gas having a bacteriostatic effect such as carbon dioxide gas, a mixed gas of carbon dioxide gas and nitrogen gas is encapsulated together with the packed material, whereby pH of the packed material can be lowered to suppress the growth of anaerobic bacteria effectively.

Figure 6:
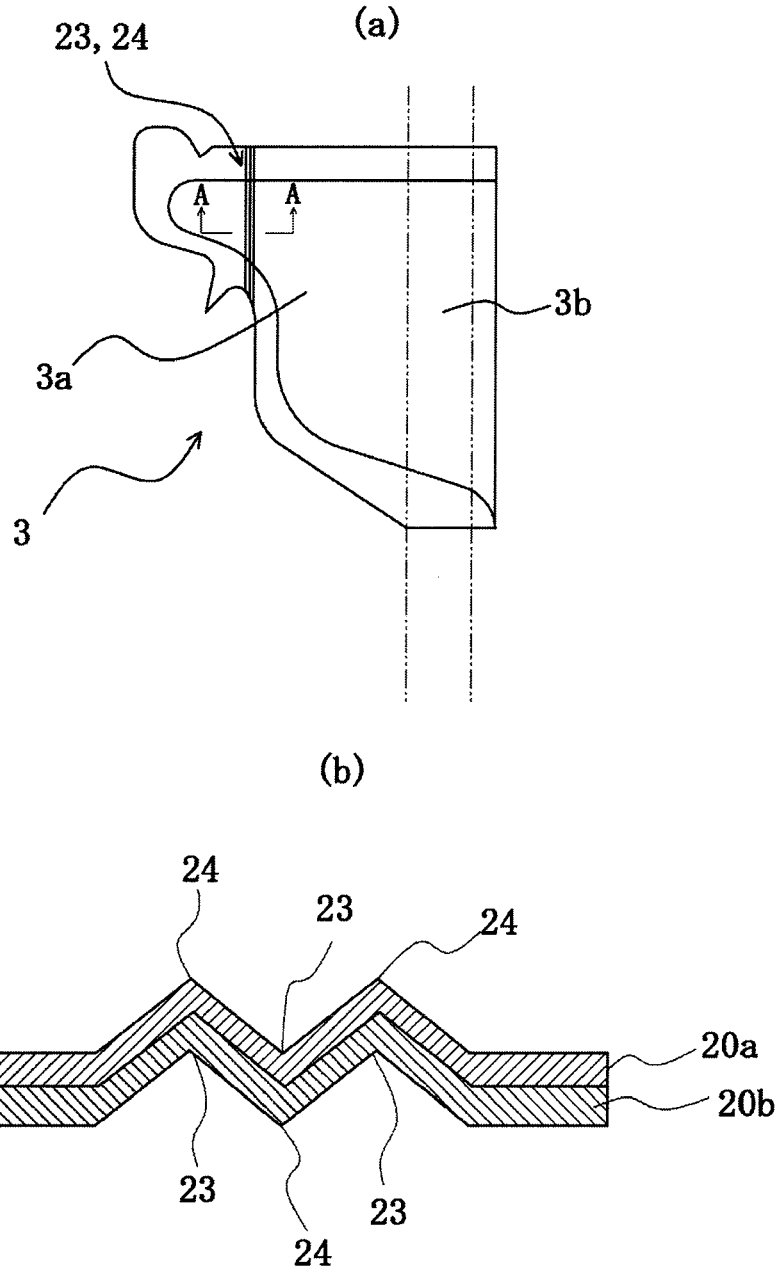
FIG. 6 is a partial plain view (a) and a section view (b) in a line A-A when irregular stripes are disposed in a film-shaped pouring nozzle.

According to the invention, in order to improve the self-sealing function by adhesion between mutual inner faces of the pouring path 3*a* in the film-shaped pouring nozzle 3 when the pouring of the packed material is stopped and the packaging bag returns to a standing posture, as shown in FIG. 6, it is preferable to arrange at least one irregular stripe 23, 24 extending across the pouring path 3*a* of the film-shaped pouring nozzle 3 and entering between the mutual laminate films for the nozzle 20*a*, 20*b* as shown in a section view (FIG. 6(*b*)) in a line A-A of FIG. 6(*a*) at a position of the vicinity of a pouring port on the laminate films 20*a*, 20*b* constituting the film-shaped pouring nozzle 3. In this case, elastic restoring force of the laminate films 20*a*, 20*b* to initial state can be increased to perform the adhesion between the mutual inner faces of the pouring path 3*a* rapidly and surely, whereby the self-sealing function can be developed effectively. Particularly, the formation of the irregular stripe 23, 24 is very effective because there is a fear of penetrating the gas into the pouring path 3*a* of the film-shaped pouring nozzle to block the adhesion between the mutual inner faces of the pouring path 3*a* when the gas is encapsulated into the main bag body 2 together with the packed material as mentioned above.

The method of forming the packaging bag 1 according to the invention is not specified to the above case. For example, an example of integrally uniting the protect cover 4 with the main bag body 2 can be performed simply by superimposing the two laminate films for the main bag body, fusion-joining their side edge parts 7*a*, 7*b* and lower edge parts 6 to each other, inserting the film-shaped pouring nozzle 3 into the shoulder part intersecting the upper edge part 9 with the side edge part 7*a* through the upper edge part 9, heat-sealing the base part 3*b* of the film-shaped pouring nozzle 3 to the laminate films for the main bag body from their upper edge parts 9 to form the cutout edge part 5*a*, and fixing and holding the film-shaped pouring nozzle 3 in the packaging bag 1 by the cutout edge part 5*a* and defining the packaging bag 1 into the protect cover 4 (notch portion 5) and the main bag body 2.

DESCRIPTION OF REFERENCE SYMBOLS

1 packaging bag
2 main bag body
2*a* side edge of main bag body
3 film-shaped pouring nozzle
4 protect cover
4*a* outer edge of protect cover
5 notch part
5*a* cutout edge part
6 lower edge part
7*a*, 7*b* side edge part
8 filling space
9 upper edge part
10 reinforcing seal portion
11 tear guiding trace
12 self-supporting bottom portion
20*a*, 20*b* laminate film for nozzle
21*a*, 21*b* laminate film for main bag body
22 gap
23 concave stripe
24 convex stripe

What is claimed is:

1. A packaging bag comprising:

a main bag body defined by at least one main bag body laminate film and having an upper edge part, a lower edge part and a pair of side edge parts sandwiched therebetween such that a filling space for a packed material is defined within the main body bag; and a pouring nozzle attached to an upper portion of the main bag body and defined by at least one pouring nozzle laminate film that is thinner than the at least one main bag body laminate film, the at least one pouring nozzle laminate film being fusion-joined at three peripheral portions thereof other than an end portion defined as a base part configured to form a pouring path that communicates with the filling space of the main bag body and to develop a self-sealing function when the packed material in the filling space is poured through the pouring path, the pouring nozzle protruding from the upper portion of the main bag body such that the pouring nozzle is prevented from extending beyond one side edge part of the pair of side edge parts and the upper edge part of the main bag body when the packed material is poured, wherein the main bag body is provided with, at an upper corner thereof between a portion of the upper edge part and a portion of the one side edge, a removable protective cover configured to house the pouring nozzle, the main bag body is provided with a cutout edge portion that extends along the upper corner of the main bag body from the portion of the upper edge part to the portion of the one side edge part, the pouring nozzle being fixed and held by the cutout edge part of the main bag body such that the pouring nozzle is fit into the protective cover at a position between the upper edge part and the one side edge part of the main bag body, the protective cover has an outer edge extending from the upper edge part and the one side edge part of the main bag body and is directly connected to and separable from the cutout edge part, and an outer face of the base part is fusion-joined to the inner face of the cutout edge part in the main bag body such that the pouring nozzle is connected to the main bag body and inner faces of the pouring path are unfused to permit the packed material to be poured.

2. The packaging bag according to claim 1, wherein a reinforcing seal portion is provided on a boundary portion between the upper and lower end portions of the base part in the pouring nozzle and the cutout edge part in the main bag body, the reinforcing seal portion being formed via at least one pressurized fusion treatment after a fusion-joining of the pouring nozzle and the main bag body.

3. The packaging bag according to claim 1, wherein the at least one pouring nozzle laminate film is a film in which a melting point of a first sealant layer that defines the pouring path of the pouring nozzle is higher than a melting point of a second sealant layer that contacts the at least one main bag body laminate film of the main bag body.

4. The packaging bag according to claim 1, wherein the protective cover comprises a pair of bag-shaped laminate films for housing the pouring nozzle in a sandwiched state.

5. The packaging bag according to claim 1, wherein the cutout edge part is one of an inclination edge part linearly inclined from the upper edge part of the at least one main bag body laminate film toward the one side edge part thereof at a downward gradient, a curved edge part expanded toward the filling space of the main bag body, or one or more horn-shaped edge parts connecting the upper edge part and the one side edge part.

6. The packaging bag according to claim 1, wherein the pouring path in the pouring nozzle extends one of upward, obliquely upward or parallel to the upper edge part of the main bag body.

7. The packaging bag according to claim 1, wherein the at least one pouring nozzle laminate film is provided with at least one bent surface section that extends across the pouring path.

8. The packaging bag according to claim 1, wherein the main bag body is provided with a bottom wall disposed in the lower edge part of the main bag body, the bottom wall is fusion-joined to an inner face wall located at a lower side of the at least one main bag body laminate film such that the main bag body is self-standing, and the lower edge part is separated into two lower edge parts having end portions that are configured to contact a surface to permit the self-standing of the main bag body.

9. The packaging bag according to claim 8, wherein when the main bag body is filled with packed material, a gas is encapsulated into the filling space of the main bag body at an amount of not less than 2 vol % per volume of the packed material filled under atmospheric pressure.

10. The packaging bag according to claim 1, wherein the main bag body is provided with a bottom wall disposed at the lower edge part of the main bag body, the bottom wall is fusion-joined to an inner face wall located at a lower side of the at least one main bag body laminate film such that the main bag body is self-standing, the lower edge part is separated into two lower edge parts having end portions that are configured to contact a surface to permit the self-standing of the main bag body, and a thickness of the at least one main bag body laminate film is 80-300 μm.

11. The packaging bag according to claim 1, wherein the protective cover includes a tear guiding trace at a position adjacent to the cutout edge portion such that the tear guiding trace extends along the extending direction of the cutout edge part from the portion of the upper edge part to the portion of the one side edge part.

* * * * *